US007969386B2

(12) United States Patent
Jung et al.

(10) Patent No.: US 7,969,386 B2
(45) Date of Patent: Jun. 28, 2011

(54) PLASMA DISPLAY APPARATUS HAVING SEPARATED ELECTRODES AND METHOD OF DRIVING PLASMA DISPLAY

(75) Inventors: Yun Kwon Jung, Gumi-si (KR); Muk Hee Kim, Daegu (KR); Byung Hyun Kim, Gumi-si (KR); Yong Hyun Huh, Busan-si (KR)

(73) Assignee: LG Electronics Inc., Seoul (KR)

( * ) Notice: Subject to any disclaimer, the term of this patent is extended or adjusted under 35 U.S.C. 154(b) by 1050 days.

(21) Appl. No.: 11/438,326

(22) Filed: May 23, 2006

(65) Prior Publication Data

US 2007/0063926 A1 Mar. 22, 2007

(30) Foreign Application Priority Data

Sep. 20, 2005 (KR) ..... 10-2005-0087472

(51) Int. Cl.
*G09G 3/28* (2006.01)

(52) U.S. Cl. ..... 345/60; 345/67

(58) Field of Classification Search ..... 345/60, 345/67

See application file for complete search history.

(56) References Cited

U.S. PATENT DOCUMENTS

| | | | | |
|---|---|---|---|---|
| 6,295,040 | B1 | 9/2001 | Nhan et al. | 345/60 |
| 6,768,478 | B1 * | 7/2004 | Wani et al. | 345/60 |
| 7,002,296 | B2 * | 2/2006 | Sano et al. | 313/583 |
| 2001/0017605 | A1 * | 8/2001 | Hashimoto et al. | 345/60 |
| 2002/0140349 | A1 * | 10/2002 | Kato et al. | 313/582 |
| 2003/0038757 | A1 * | 2/2003 | Kojima | 345/60 |
| 2003/0042855 | A1 * | 3/2003 | Chien et al. | 313/586 |
| 2003/0107532 | A1 | 6/2003 | Choi | 345/60 |
| 2003/0222835 | A1 * | 12/2003 | Yoon et al. | 345/60 |
| 2004/0095296 | A1 * | 5/2004 | Kojima et al. | 345/60 |
| 2004/0217923 | A1 * | 11/2004 | Jung et al. | 345/60 |
| 2005/0057451 | A1 | 3/2005 | Lim | 345/60 |
| 2005/0116895 | A1 * | 6/2005 | Lee et al. | 345/60 |
| 2005/0156824 | A1 * | 7/2005 | Okamoto et al. | 345/60 |
| 2005/0162345 | A1 * | 7/2005 | Kwon et al. | 345/60 |
| 2005/0243027 | A1 * | 11/2005 | Chung et al. | 345/60 |
| 2007/0035479 | A1 * | 2/2007 | Lin et al. | 345/68 |

FOREIGN PATENT DOCUMENTS

| | | | |
|---|---|---|---|
| CN | 1290001 | A | 4/2001 |
| CN | 1619622 | A | 5/2005 |
| EP | 0 657 861 | B1 | 6/1995 |
| EP | 0 866 439 | A1 | 9/1998 |
| EP | 0 903 718 | B1 | 3/1999 |

OTHER PUBLICATIONS

European Search Report dated Nov. 10, 2006. Chinese Office Action dated Feb. 29, 2008.

European Search Report for Application 06290947.8 dated Jul. 21, 2010.

Weber et al., XP00608669; "7.3: Energy Recovery Sustain Circuit for the AC Plasma Display;" SID International Symposium Digest of Technical Papers, NewOrleans, May 12-14, 1987.

* cited by examiner

*Primary Examiner* — Chanh Nguyen
*Assistant Examiner* — Kwang-Su Yang
(74) *Attorney, Agent, or Firm* — KED & Associates LLP

(57) ABSTRACT

A plasma display apparatus and a method of driving the plasma display apparatus are provided. The plasma display apparatus includes a plasma display panel including a first electrode and a second electrode, a first electrode driver, and a second electrode driver. The first electrode driver supplies a first falling signal of a voltage magnitude, that is more than a voltage magnitude of a scan signal supplied during an address period, to the first electrode before the supply of a rising signal with a gradually rising voltage in at least one subfield of several subfields of a frame. The second electrode driver supplies a second signal having a polarity opposite a polarity of the first falling signal to the second electrode during the supply of the first falling signal.

17 Claims, 15 Drawing Sheets

(b)

(a)

PLASMA DISPLAY APPARATUS HAVING SEPARATED ELECTRODES AND METHOD OF DRIVING PLASMA DISPLAY

This Nonprovisional application claims priority under 35 U.S.C. §119(a) on Patent Application No. 10-2005-87472 filed in Korea on Sep. 20, 2005 the entire contents of which are hereby incorporated by reference.

BACKGROUND OF THE INVENTION

1. Field of the Invention

This document relates to a plasma display apparatus and a method of driving the plasma display apparatus.

2. Description of the Background Art

A plasma display apparatus comprises a plasma display panel and a driver for supplying a driving voltage to the plasma display panel.

The plasma display apparatus displays an image on the plasma display panel. The plasma display panel comprises cells formed by barrier ribs formed between a front panel and a rear panel. Each of the cells is filled with an inert gas containing a main discharge gas such as neon (Ne), helium (He) or a Ne—He gas mixture and a small amount of xenon (Xe). When a driving signal is supplied to an electrode of the plasma display panel, a discharge is generated. A protective layer such as a MgO layer is provided to help the generation of the discharge and to protect the electrode of the plasma display panel. When generating the discharge, the inert gas within the cells generates vacuum ultraviolet rays. The vacuum ultraviolet rays emit a phosphor formed between the barrier ribs such that the image is displayed.

The plasma display panel represents gray scale by a combination of subfields constituting a frame. One frame comprises a plurality of subfields. Each of the subfields comprises a reset period for initializing the cells, an address period for selecting cells, and a sustain period for emitting the selected cells. The gray scale of the image is represented by changing gray level of the sustain period in accordance with the combination of the subfields.

In the reset period of the subfield, a reset signal is supplied to a scan electrode of the plasma display panel so that all of the cells of the plasma display panel are initialized. In the address period, a scan signal is supplied to the scan electrode and a data signal is supplied to an address electrode of the plasma display panel so that cells are selected. In the sustain period, a sustain signal is supplied to at least one of the scan electrode and a sustain electrode of the plasma display panel, so that a sustain discharge is generated in the selected cells.

The discharge generated in the plasma display panel is affected by various factors. In particular, structures of the scan electrode and the sustain electrode of the plasma display panel greatly affect the discharge.

SUMMARY OF THE INVENTION

According to one aspect, there is provided a plasma display apparatus comprising a plasma display panel comprising a first electrode and a second electrode, a first electrode driver for supplying a first falling signal of a voltage magnitude, that is more than a voltage magnitude of a scan signal supplied during an address period, to the first electrode before the supply of a rising signal with a gradually rising voltage in at least one subfield of several subfields of a frame, and a second electrode driver for supplying a second signal having a polarity opposite a polarity of the first falling signal to the second electrode during the supply of the first falling signal.

According to another aspect, there is provided a method of driving a plasma display apparatus comprising a first electrode and a second electrode, comprising supplying a first falling signal with a gradually falling voltage to the first electrode before a reset period in at least one subfield of subfields of a frame, supplying a second signal having a polarity opposite a polarity of the first falling signal to the second electrode during the supply of the first falling signal, and supplying a scan signal of a voltage magnitude, that is less than a voltage magnitude of the first falling signal, to the first electrode during an address period which follows the reset period.

According to still another aspect, there is provided a plasma display apparatus comprising a plasma display panel comprising a scan electrode and a sustain electrode which are separated from each other by 90 μm to 150 μm, a scan driver for supplying a first falling signal of a voltage magnitude more than a voltage magnitude of a scan signal supplied during an address period to the scan electrode prior to the supply of a rising signal with a gradually rising voltage in at least one subfield of several subfields of a frame, and a sustain driver for supplying a second signal having a polarity opposite a polarity of the first falling signal to the sustain electrode during the supply of the first falling signal.

BRIEF DESCRIPTION OF THE DRAWINGS

The embodiment of the invention will be described in detail with reference to the following drawings in which like numerals refer to like elements.

DETAILED DESCRIPTION OF PREFERRED EMBODIMENTS

Figure 1:
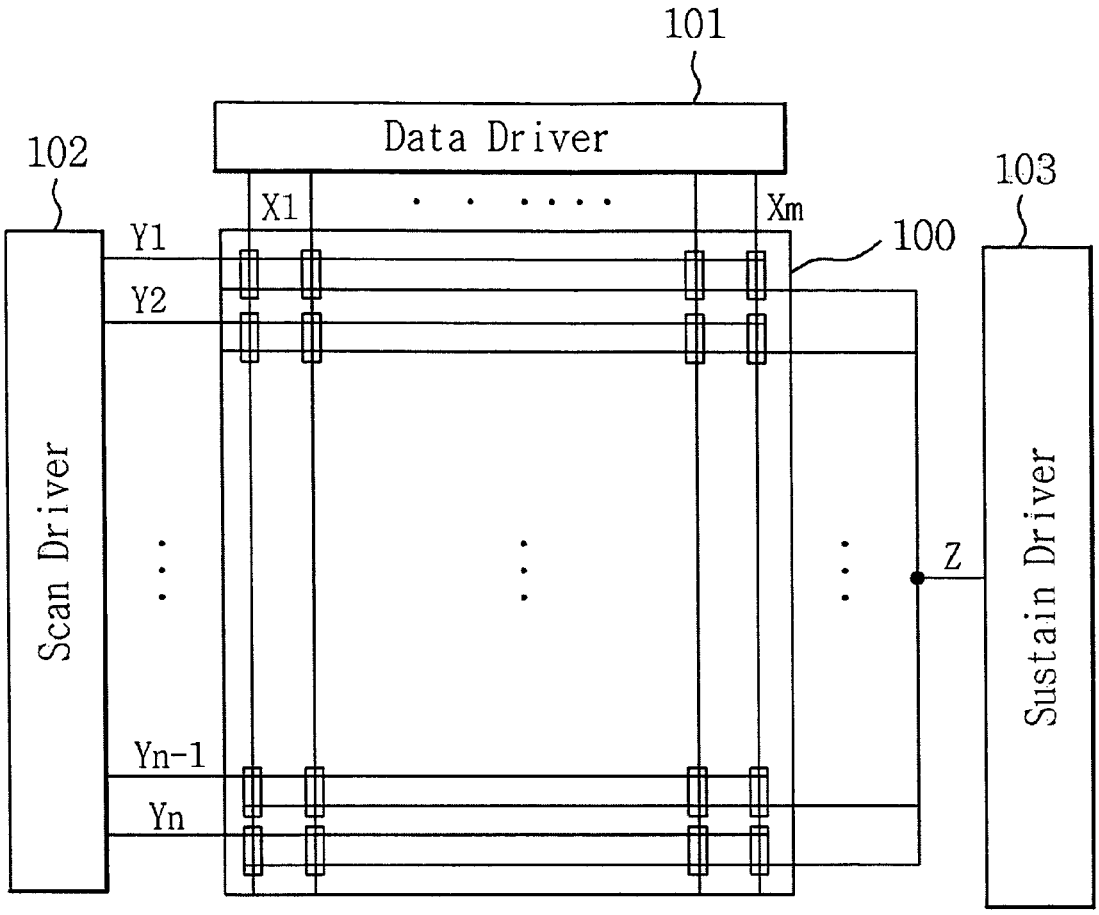
FIG. 1 illustrates a plasma display apparatus according to an embodiment of the present invention.

Embodiments of the present invention will be described in a more detailed manner with reference to the drawings.

A plasma display apparatus according to an embodiment of the present invention comprises a plasma display panel comprising a first electrode and a second electrode, a first electrode driver for supplying a first falling signal of a voltage magnitude, that is more than a voltage magnitude of a scan signal supplied during an address period, to the first electrode before the supply of a rising signal with a gradually rising voltage in at least one subfield of several subfields of a frame, and a second electrode driver for supplying a second signal having a polarity opposite a polarity of the first falling signal to the second electrode during the supply of the first falling signal.

The first falling signal or the second signal may be supplied in a first subfield.

The voltage magnitude of the first falling signal may be three times more than the voltage magnitude of the scan signal.

A voltage magnitude of the second signal may be substantially equal to or less than a voltage magnitude of a sustain signal supplied to the first electrode or the second electrode during a sustain period which follows the address period.

The rising signal may rise from a setup reference voltage.

A magnitude of the setup reference voltage may be substantially equal to the voltage magnitude of the scan reference voltage supplied to the first electrode during the address period.

A voltage magnitude of the rising signal may be substantially equal to a sum of the voltage magnitude of the sustain signal supplied to the first electrode or the second electrode during the sustain period and the magnitude of a scan reference voltage which are supplied to the first electrode during an address period.

Subsequent to the application of the rising signal in at least one subfield, the first electrode driver may supply at least one falling signal with a gradually falling voltage.

A voltage magnitude of at least one falling signal may be substantially equal to a voltage magnitude of a sustain signal supplied to the first electrode or the second electrode during the sustain period.

At least one falling signal may comprise a second falling signal with a gradually falling voltage of a polarity equal to a polarity of the rising signal, and a third falling signal with a gradually falling voltage of a polarity opposite the polarity of the rising signal.

At least one falling signal may have a negative voltage of a voltage magnitude less than the voltage magnitude of a scan signal supplied to the first electrode during an address period.

The second electrode driver may supply a first sustain bias voltage to the second electrode in a part of a whole period where at least one falling signal is supplied. A voltage magnitude of the first sustain bias voltage may be less than the voltage magnitude of a second sustain bias voltage supplied to the second electrode during an address period of at least one subfield.

The first bias voltage may be supplied to the second electrode in a period where a voltage of at least one falling signal is less than a ground level voltage.

A voltage magnitude of the first sustain bias voltage may range from 40% to 60% of a voltage magnitude of the second sustain bias voltage.

The second sustain bias voltage may be supplied during the duration of time from a supply finish time point of at least one falling signal to a supply time point of the scan signal first supplied during the address period.

The voltage magnitude of the second sustain bias voltage may be substantially equal to or less than the voltage magnitude of the sustain signal supplied to the first electrode or the second electrode during the sustain period.

A distance between the first electrode and the second electrode may range from 90 um to 150 um.

A distance between the first electrode and the second electrode may range from 120 um to 150 um.

The second electrode driver may comprise an energy recovery circuit unit for supplying a voltage of a sustain signal to the second electrode during a sustain period which follows the address period. The second electrode driver may supply a predetermined voltage to the second electrode by using a voltage charged to at least one capacitor of the energy recovery circuit unit, before the address period.

A magnitude of the predetermined voltage may be substantially equal to half a voltage magnitude of the sustain signal.

A method of driving a plasma display apparatus comprising a first electrode and a second electrode according to the embodiment of the present invention comprises supplying a first falling signal with a gradually falling voltage to the first electrode before a reset period in at least one subfield of subfields of a frame, supplying a second signal having a polarity opposite a polarity of the first falling signal to the second electrode during the supply of the first falling signal, and supplying a scan signal of a voltage magnitude, that is less than a voltage magnitude of the first falling signal, to the first electrode during an address period which follows the reset period.

A whole supply period of the first falling signal may overlap a part of a supply period of the second signal.

A plasma display apparatus according to the embodiment of the present invention comprises a plasma display panel comprising a scan electrode and a sustain electrode which are separated from each other by 90 μm to 150 μm, a scan driver for supplying a first falling signal of a voltage magnitude more than a voltage magnitude of a scan signal supplied during an address period to the scan electrode prior to the supply of a rising signal with a gradually rising voltage in at least one subfield of several subfields of a frame, and a sustain driver for supplying a second signal having a polarity opposite a polarity of the first falling signal to the sustain electrode during the supply of the first falling signal.

Hereinafter, exemplary embodiments of the present invention will be described in detail with reference to the attached drawings.

FIG. 1 illustrates a plasma display apparatus according to an embodiment of the present invention. As shown in FIG. 1, the plasma display apparatus according to the embodiment of the present invention comprises a plasma display panel 100, a data driver 101, a scan driver 102 and a sustain driver 103.

The plasma display panel 100 comprises address electrodes X1 to Xm, scan electrodes Y1 to Yn, and sustain electrodes Z.

The data driver 101 drives the address electrodes X1 to Xm. In other words, the data driver 101 supplies a data signal for selecting cells during an address period, which follows a reset period of each of subfields, to the address electrodes X1 to Xm.

The scan driver 102 drives the scan electrodes Y1 to Yn. In other words, the scan driver 102 supplies a first falling signal having a voltage magnitude, that is more than a voltage magnitude of a scan signal supplied during an address period of at least one subfield of the subfields constituting a frame, to the scan electrodes Y1 to Yn before the reset period. The scan driver 102 will be described in detail later.

The sustain driver 103 drives the sustain electrodes Z. In other words, the sustain driver 103 supplies a second signal of a polarity opposite a polarity of the first falling signal to the sustain electrodes Z during the supply of the first falling signal to the scan electrodes Y1 to Yn. The sustain driver 103 will be described in detail later.

Figure 2:
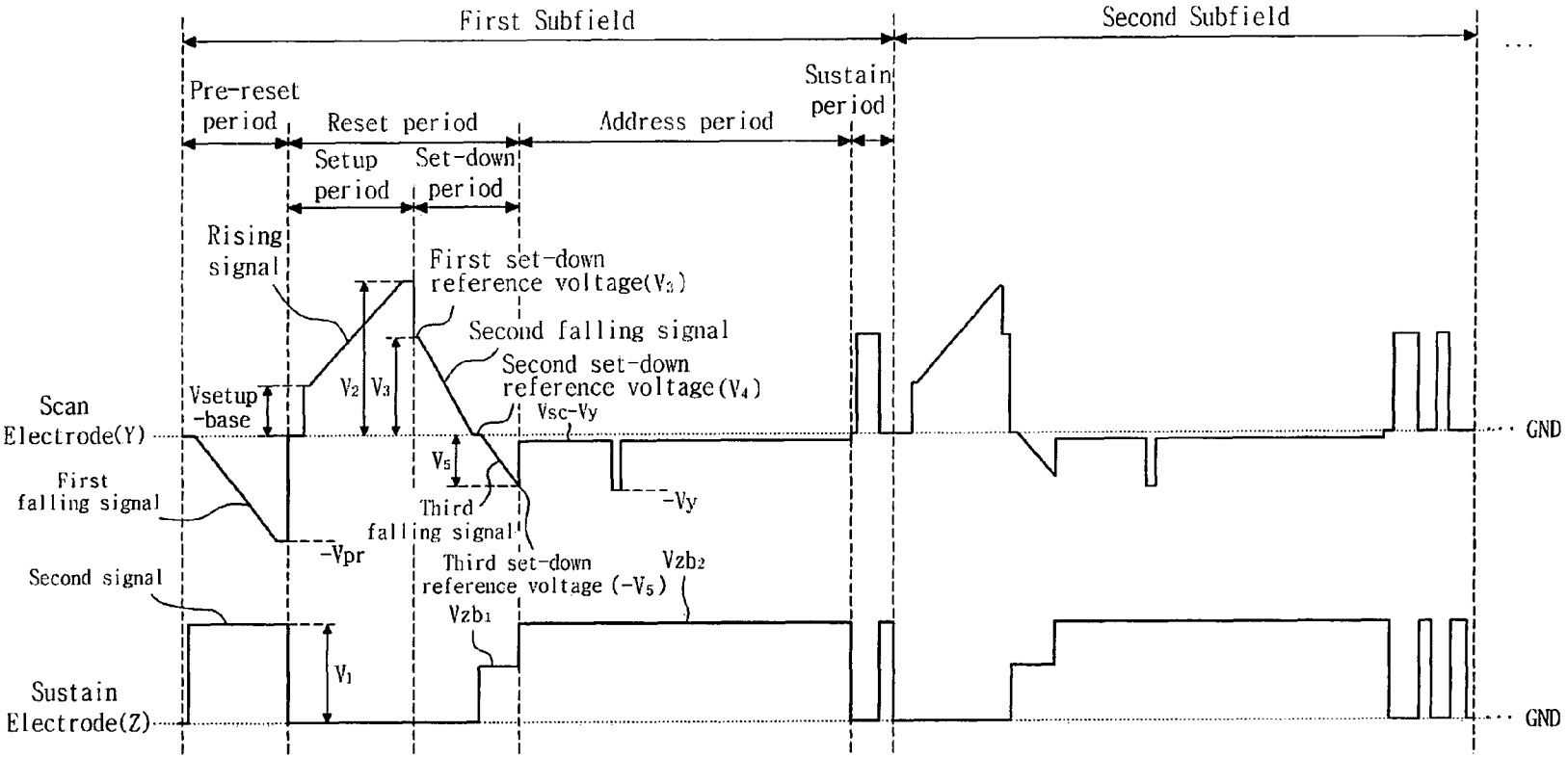
FIG. 2 illustrates a driving signal supplied from the plasma display apparatus according to the embodiment of the present invention.

FIG. 2 illustrates a driving signal supplied from the plasma display apparatus according to the embodiment of the present invention. As shown in FIG. 2, the plasma display apparatus according to the embodiment of the present invention is driven by dividing each of the subfields into a reset period for initializing the cells, an address period for selecting the cells, and a sustain period for maintaining the emission of the selected cells. In particular, at least one subfields of the plurality of subfields of one frame further comprises a pre-reset period for helping the performance of a reset discharge prior to the reset period.

The scan driver 102 of FIG. 1 supplies a driving signal of a waveform illustrated in FIG. 2 to the scan electrode Y. The sustain driver 103 of FIG. 1 supplies a driving signal of a waveform illustrated in FIG. 2 to the sustain electrode Z.

In particular, the scan driver 102 of FIG. 1 supplies the first falling signal to the scan electrode Y in the pre-reset period. The first falling signal gradually falls to a voltage −Vpr, that is less than a voltage −Vy of a scan signal supplied in the address period. The sustain driver 103 of FIG. 1 supplies the second signal of a positive voltage V1 to the sustain electrode Z during the supply of the first falling signal to the scan electrode Y. The whole of a supply period of the first falling signal overlaps a part of a supply period of the second signal. That is, the first falling signal is supplied within the duration of time of the supply period of the second signal.

Figure 3A:
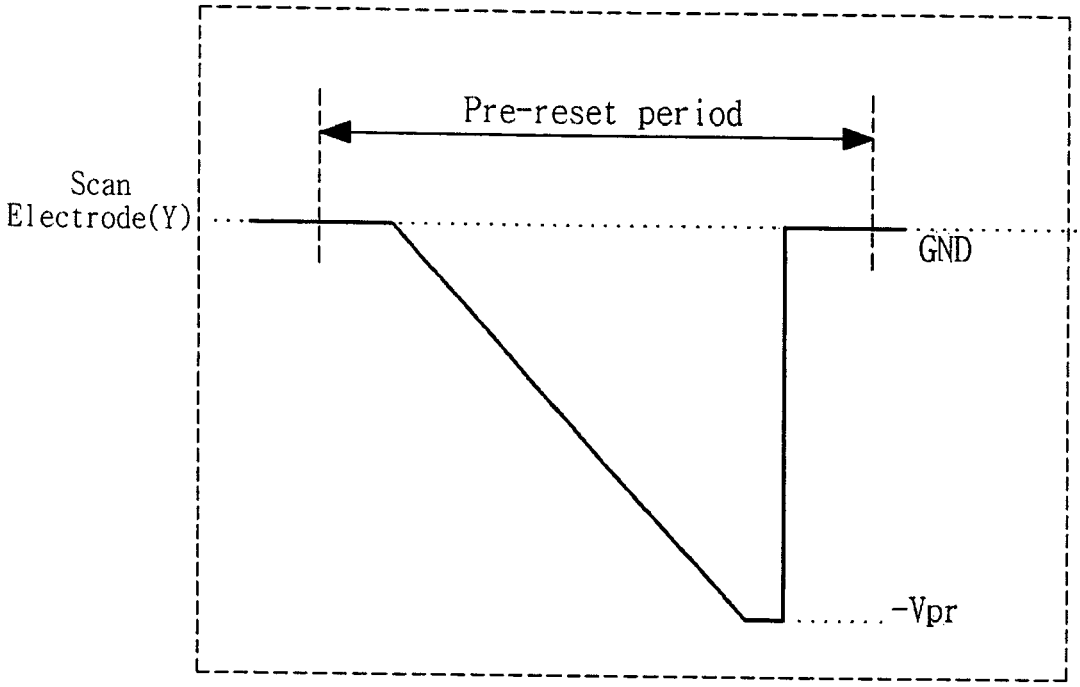
FIGS. 3*a* and 3*b* illustrate voltages supplied to a scan electrode during a pre-reset period and an address period in the plasma display apparatus according to the embodiment of the present invention.
Figure 3B:
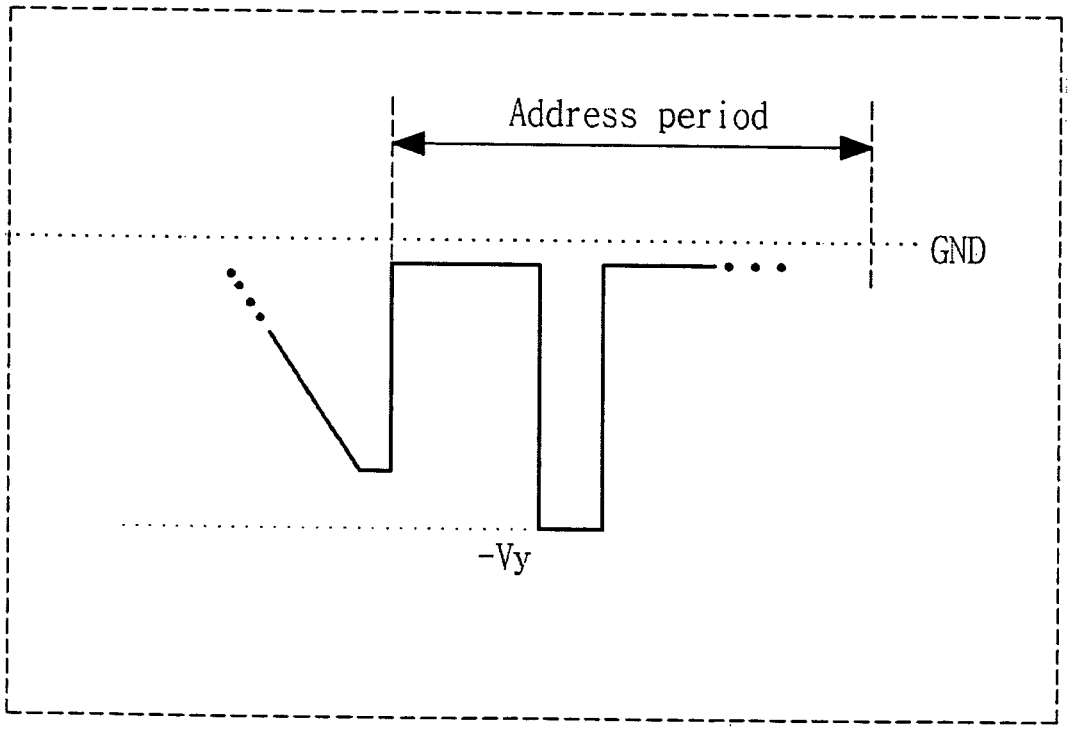

FIGS. 3*a* and 3*b* illustrate a voltage supplied to a scan electrode during a pre-reset period in the plasma display apparatus according to the embodiment of the present invention. As shown in FIG. 3*a,* a magnitude of the voltage −Vpr of the first falling signal supplied to the scan electrode Y during the pre-reset period is more than a magnitude of the voltage −Vy of the scan signal supplied to the scan electrode Y during the address period, as shown in FIG. 3*b.* The magnitude of the voltage −Vpr of the first falling signal is three times more than the magnitude of the voltage −Vy of the scan signal.

Figure 4:
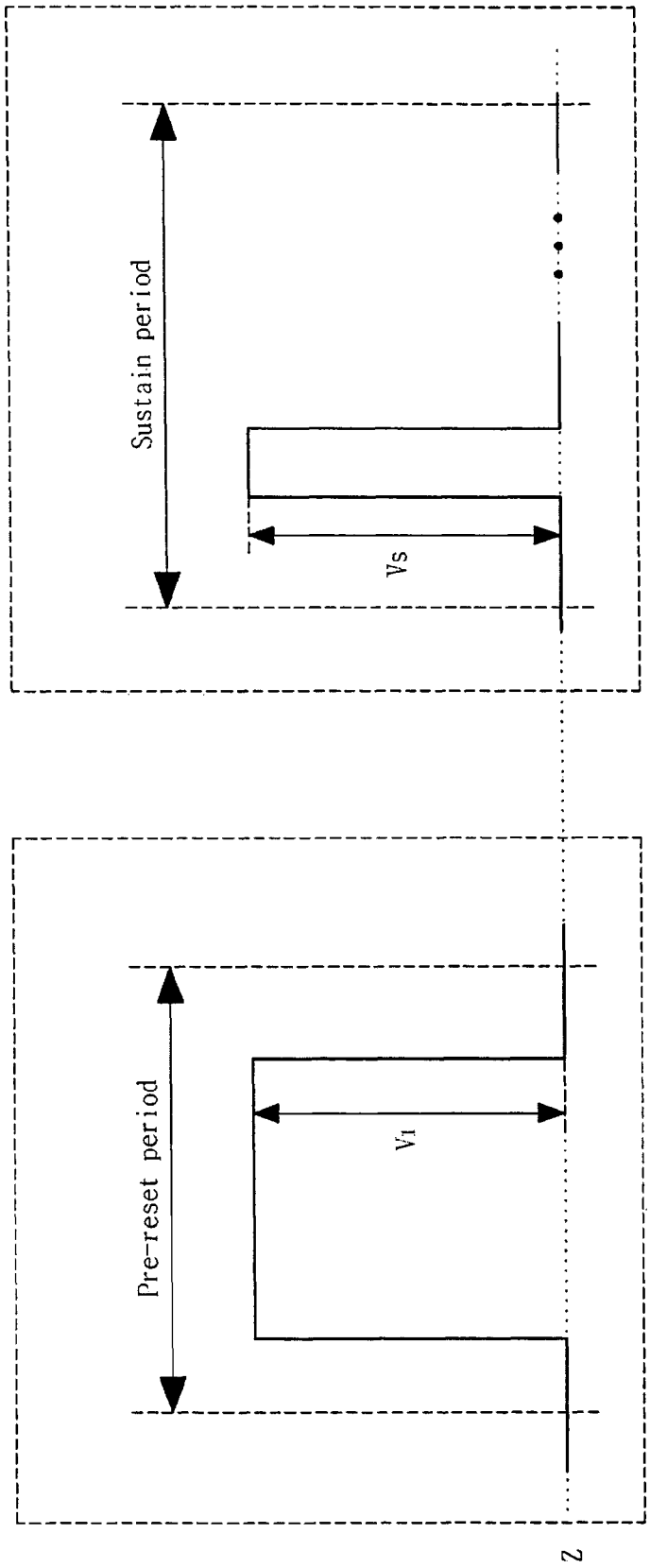
FIG. 4 illustrates voltages supplied to a sustain electrode during the pre-reset period and a sustain period in the plasma display apparatus according to the embodiment of the present invention.

FIG. 4 illustrates a voltage supplied to a sustain electrode during the pre-reset period in the plasma display apparatus according to the embodiment of the present invention. As shown in FIG. 4, the sustain driver 103 of FIG. 1 supplies the second signal to the sustain electrode Z during the pre-reset period. A magnitude of the voltage V1 of the second signal is substantially equal to or less than a magnitude of a voltage Vs of a sustain signal supplied during the sustain period.

Positive wall charges and negative wall charges are accumulated on the scan electrode and the sustain electrode in the pre-reset period in the plasma display apparatus according to the embodiment of the present invention, respectively. Accordingly, the reset discharge performed in the reset period is easily generated. Moreover, even when the magnitude of the reset signal supplied to the scan electrode during the reset period decreases, the reset discharge is effectively generated.

FIGS. 5*a* to 5*d* illustrate the pre-reset period in the plasma display apparatus according to the embodiment of the present invention.

Figure 5A:
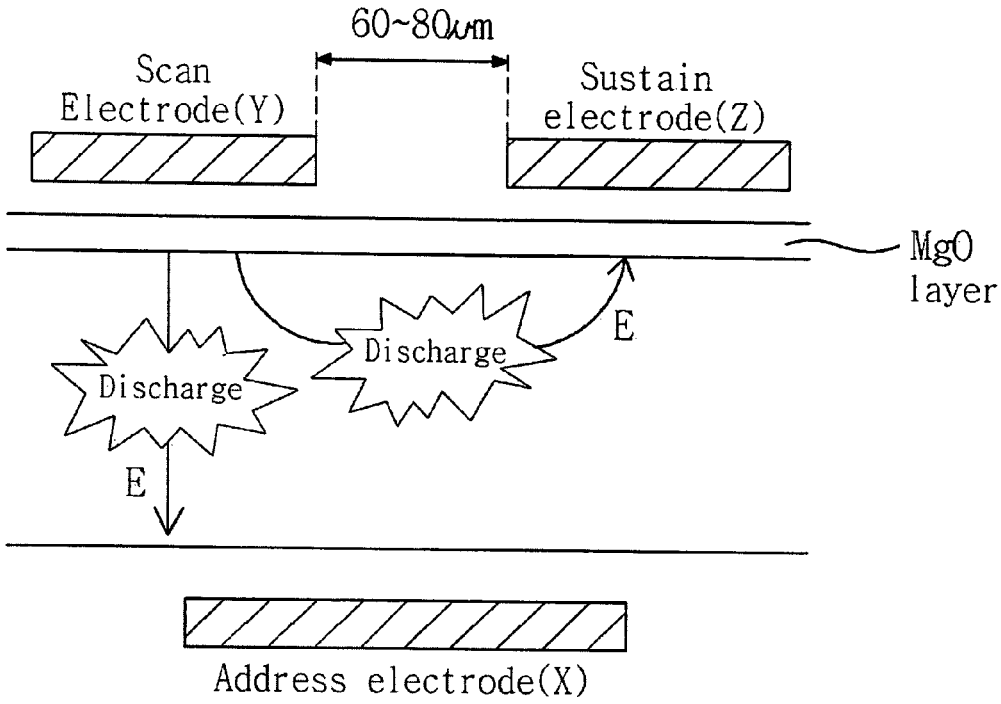
FIGS. 5*a* to 5*d* illustrate the pre-reset period in the plasma display apparatus according to the embodiment of the present invention.

As shown in FIG. 5*a,* suppose that the plasma display panel comprises the scan electrode Y and the sustain electrode Z, which are separated from each other by a short distance of 60 μm to 80 μm, and a rising signal with a gradually rising voltage is supplied to the scan electrode Y.

Since the distance between the scan electrode Y and the sustain electrode Z is short, a reset discharge of a surface discharge type is first generated between the scan electrode Y and the sustain electrode Z. Subsequent to the reset discharge of the surface discharge type, a reset discharge of an opposite discharge type is generated between the scan electrode Y and the address electrode X.

The intensity of the reset discharge of the surface discharge type generated between the scan electrode Y and the sustain electrode Z is more than the intensity of the reset discharge of the opposite discharge type generated between the scan electrode Y and the address electrode X by secondary electrons emitted from a protective layer such as a MgO layer. Thus, even when the magnitude of the voltage of the first falling signal supplied to the scan electrode Y in the pre-reset period is not large, the reset discharge is stably generated in the reset period.

Figure 5B:
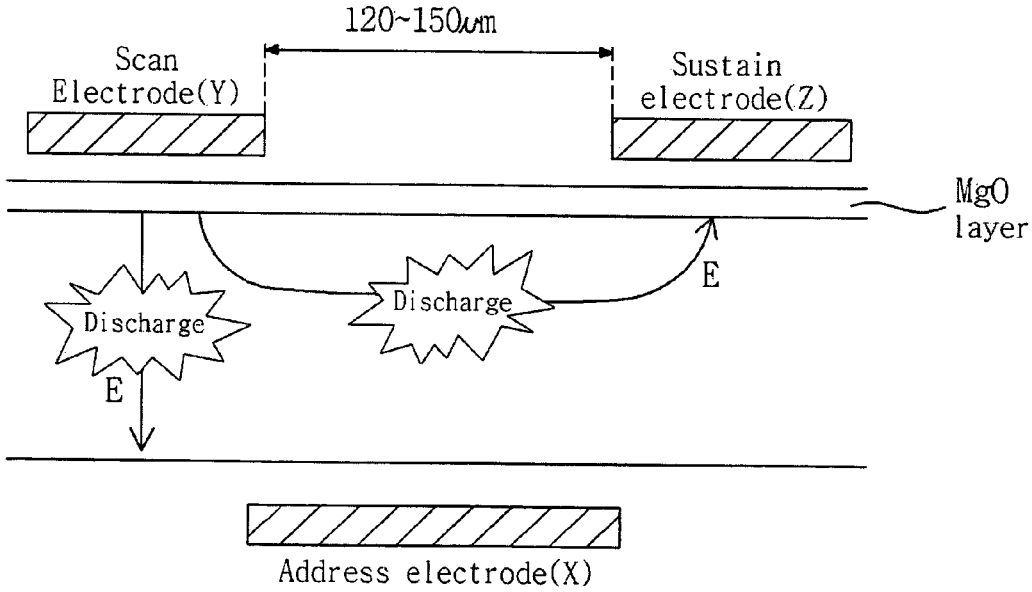

As shown in FIG. 5*b,* suppose that the plasma display panel comprises the scan electrode Y and the sustain electrode Z, which are separated from each other by a long distance of 120 μm to 150 μm, and a rising signal with a gradually rising voltage is supplied to the scan electrode Y.

Since the distance between the scan electrode Y and the sustain electrode Z in FIG. 5*b* is more then the distance between the scan electrode Y and the sustain electrode Z in FIG. 5*a,* a discharge start voltage becomes higher. Thus, before a reset discharge of a surface discharge type is generated between the scan electrode Y and the sustain electrode Z, a reset discharge of an opposite discharge type is generated between the scan electrode Y and the address electrode X. There is a strong likelihood that the intensity of the reset discharge of the surface discharge type generated between the scan electrode Y and the sustain electrode Z is less than the intensity of the reset discharge of the opposite discharge type generated between the scan electrode Y and the address electrode X.

When the reset discharge of the opposite discharge type is generated before the generation of the reset discharge of the surface discharge type, the efficiency of the reset discharge decreases. The protective layer such as the MgO layer is formed on the scan electrode Y and the sustain electrode Z and is not formed on the address electrode X. When positive ions collide with the protective layer, the protective layer emits the secondary electrons for helping the generation of the discharge. Thus, the reset discharge of the surface discharge type needs to be generated before the generation of the reset discharge of the opposite discharge type to increase the efficiency of the reset discharge.

When the reset discharge of the opposite discharge type is generated before the generation of the reset discharge of the surface discharge type, the protective layer does not emit the secondary electrons. Thus, the efficiency of the reset discharge decreases and the charges collide with phosphors formed on the address electrode X such that life span of the plasma display apparatus decreases. Further, since emission characteristics of red, green and blue phosphors are different from one another, the quantity of light emitted from the phosphors by the collision of the charges and the phosphors are different from another. As a result, image quality of the plasma display apparatus is degraded.

When the distance between the scan electrode Y and the sustain electrode Z of the plasma display apparatus according to the embodiment of the present invention is large as in FIG. 5*b,* the magnitude of the voltage −Vpr of the first falling signal supplied to the scan electrode Y in the pre-reset period is more than the magnitude of the voltage −Vy of the scan signal supplied to the scan electrode Y in the address period. Thus, the reset discharge of the surface discharge type is generated before the generation of the reset discharge of the opposite discharge type such that the reset discharge is stably generated.

As described above, in the plasma display apparatus according to the embodiment of the present invention, when the magnitude of the voltage −Vpr of the first falling signal supplied to the scan electrode Y in the pre-reset period is more than the magnitude of the voltage −Vy of the scan signal supplied to the scan electrode Y in the address period. Thus, even when the scan electrode Y and the sustain electrode Z are separated from each other by a long distance of 90 μm to 150 μm, the reset discharge of the surface discharge type is generated before the generation of the reset discharge of the opposite discharge type.

Figure 5C:
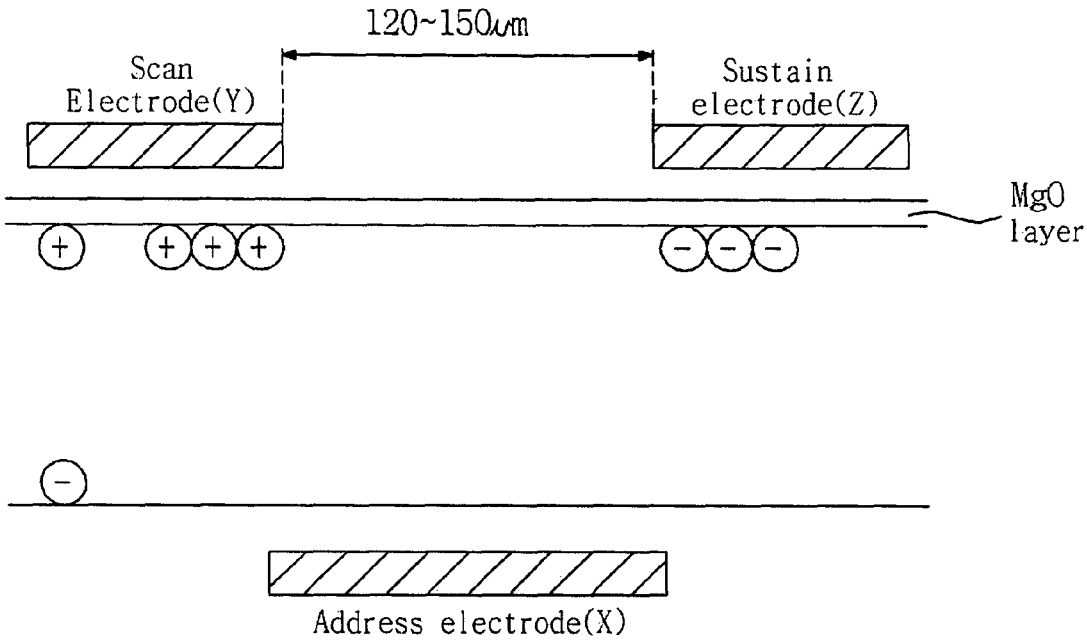
Figure 5D:
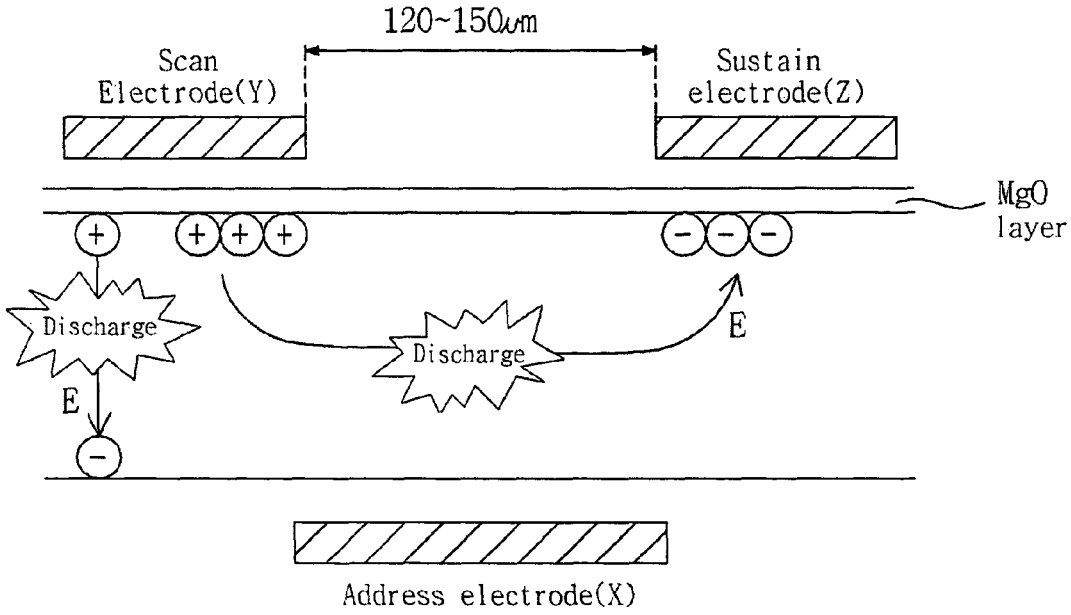

As shown in FIG. 5*c,* the first falling signal of the voltage magnitude, that is more than the magnitude of the voltage −Vy of the scan signal, ' is supplied to the scan electrode Y. At this time, even when the scan electrode Y and the sustain electrode Z are separated from each other by the distance of 90 μm to 150 μm, many negative wall charges are accumulated on the scan electrode Y and more positive wall charges are accumulated on the sustain electrode Z. Thus, the reset discharge of the surface discharge type is generated before the generation of the reset discharge of the opposite discharge type.

In the plasma display apparatus according to the embodiment of the present invention, the first falling signal of the voltage magnitude, that is more than the magnitude of the voltage −Vy of the scan signal, is supplied to the scan electrode Y, and the second signal substantially equal to the magnitude of the voltage Vs of the sustain signal is supplied to the sustain electrode Z in a pre-reset period of an earliest subfield of the plurality of subfields. Thus, the reset discharge is stably generated in a reset period of the earliest subfield of the plurality of subfields such that the reset discharge is stably generated in the subfields subsequent to the earliest subfield.

Figure 6:
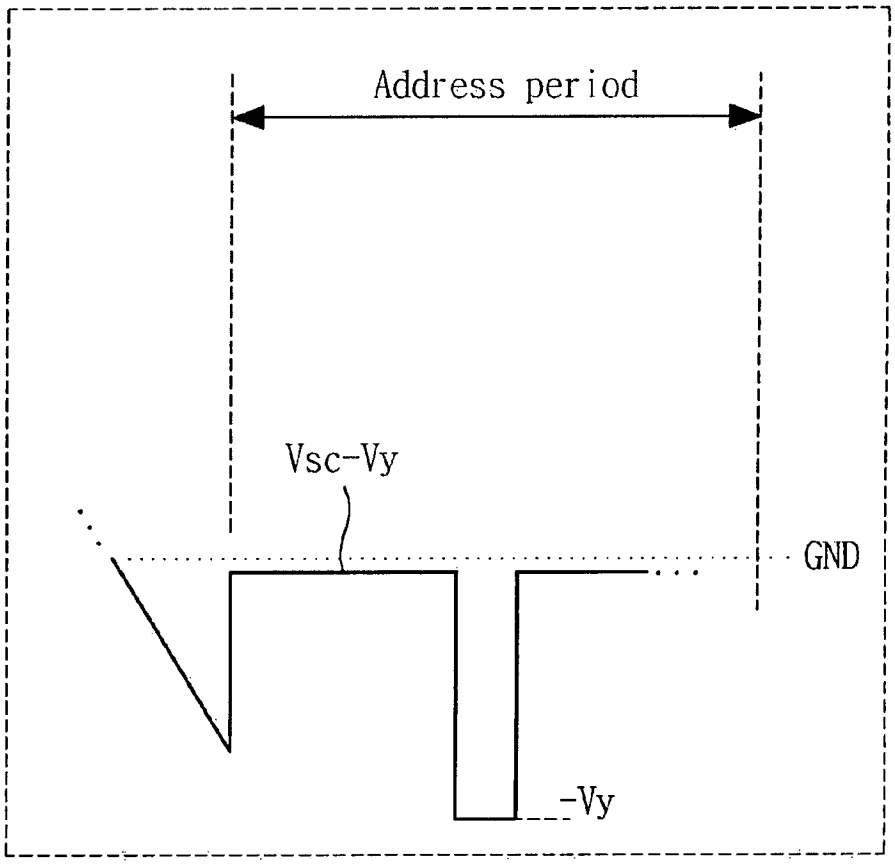
FIG. 6 illustrates a setup reference voltage supplied during a setup period of a reset period in the plasma display apparatus according to the embodiment of the present invention.
Figure 6:
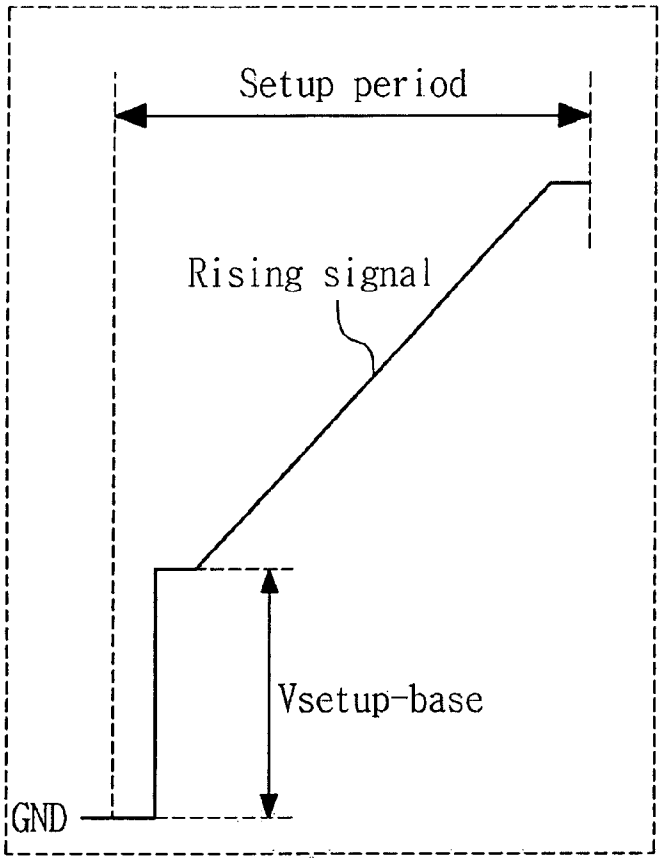

FIG. 6 illustrates a setup reference voltage supplied during a setup period of a reset period in the plasma display apparatus according to the embodiment of the present invention. A magnitude of a setup reference voltage Vsetup-base as shown in (a) of FIG. 6 is substantially equal to a magnitude of a scan reference voltage Vsc, which are supplied to the scan electrode Y in the address period, as shown in (b) of FIG. 6. That is, a relationship of Vsetup-base=Vsc is satisfied. After the supply of the setup reference voltage Vsetup-base, the rising signal rises from the setup reference voltage Vsetup-base. A scan bias voltage is substantially equal to a sum of the scan reference voltage Vsc and a voltage −Vy of a scan signal.

Even when the voltage of the scan electrode Y sharply rises up to the setup reference voltage Vsetup-base prior to the supply of the rising signal as shown in FIG. 6, the generation of the excessive quantity of the light is prevented. This reason is that the discharge start voltage between the scan electrode Y and the sustain electrode Z is high when the distance between the scan electrode Y and the sustain electrode Z is large.

Figure 7:
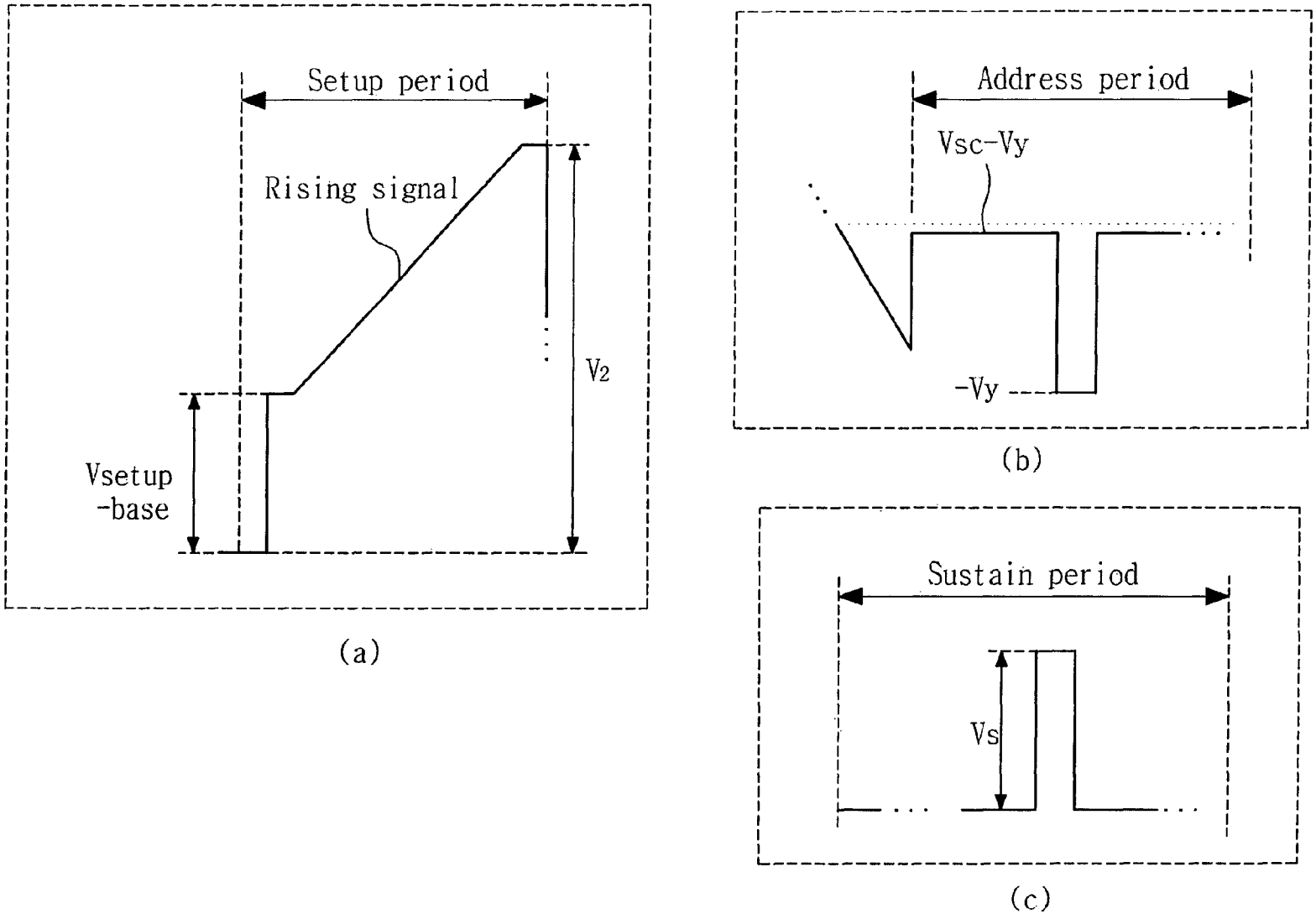
FIG. 7 illustrates a voltage of a rising signal supplied during the setup period of the reset period in the plasma display apparatus according to the embodiment of the present invention.

FIG. 7 illustrates a voltage of a rising signal supplied during the setup period of the reset period in the plasma display apparatus according to the embodiment of the present invention.

The voltage magnitude of the rising signal supplied to the scan electrode Y in the setup period of the reset period as shown in (a) of FIG. 7 is substantially equal to a sum (=Vs+Vsc) of the magnitude of the voltage Vs of the sustain signal supplied in the sustain period as shown in (c) of FIG. 7, and the magnitude of the scan reference voltage Vsc, which are supplied to the scan electrode Y in the address period as shown in (b) of FIG. 7.

A setup discharge is generated within the cells by the rising signal supplied in the setup period. As described in FIGS. 5*a* to 5*d,* the reset discharge of the surface discharge type is generated before the reset discharge of the opposite discharge type. Positive wall charges are accumulated on the address electrode X and the sustain electrode Z and negative wall charges are accumulated on the scan electrode Y by the setup discharge.

Figure 8:
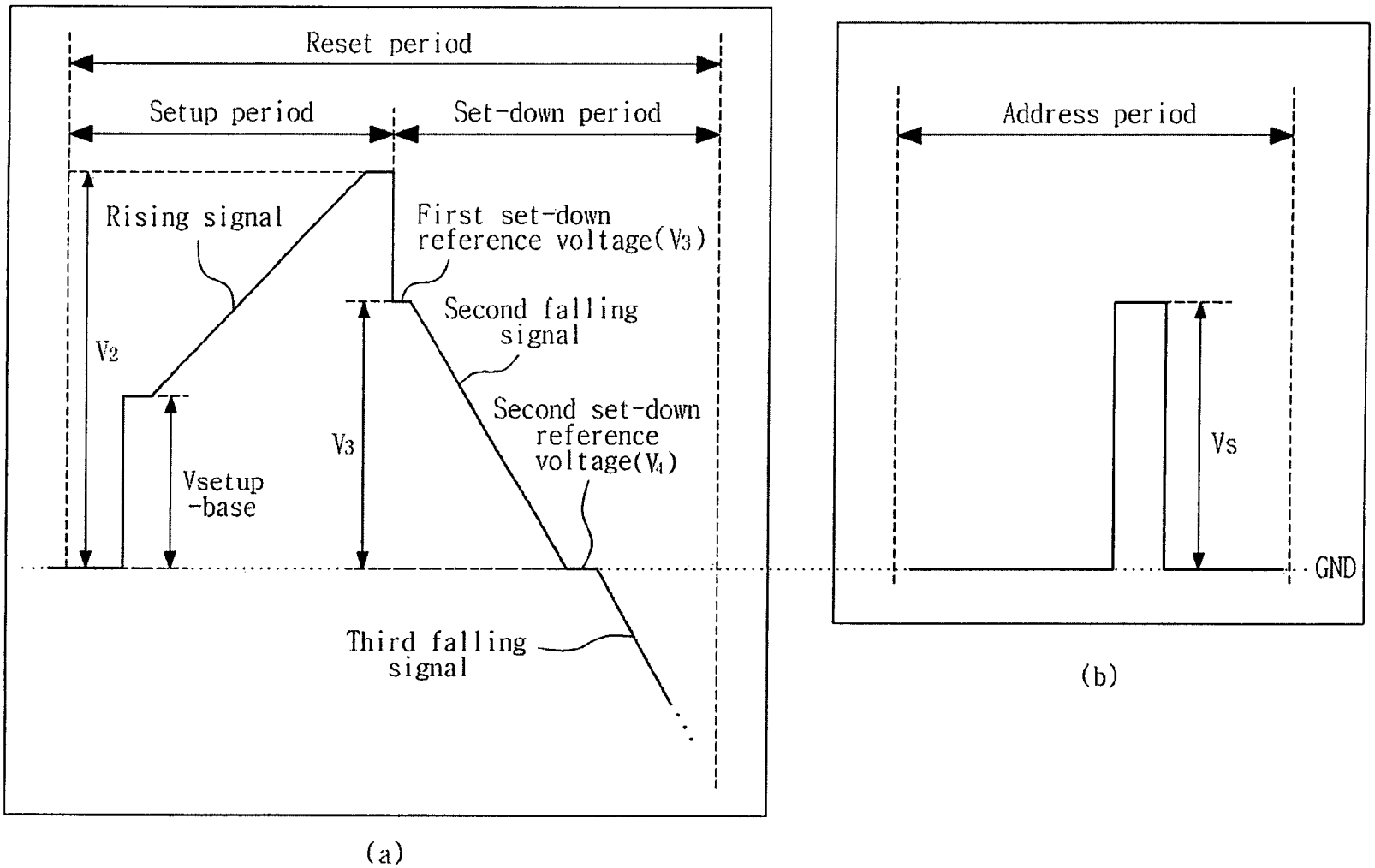
FIG. 8 illustrates a first set-down reference voltage and a second set-down reference voltage supplied during a set-down period of the reset period in the plasma display apparatus according to the embodiment of the present invention.

FIG. 8 illustrates a first set-down reference voltage and a second set-down reference voltage supplied during a set-down period of the reset period in the plasma display apparatus according to the embodiment of the present invention. A magnitude of a first set-down reference voltage V3 supplied during the set-down period as shown in (a) of FIG. 8 is substantially equal to the magnitude of the voltage Vs of the sustain signal supplied during the sustain period as shown in (b) of FIG. 8.

The reason to supply the first set-down reference voltage V3 of the magnitude substantially equal to the magnitude of the voltage Vs of the sustain signal is to improve the stability of a driving circuit by supplying the voltage Vs of the sustain signal before the supply of the second falling signal.

A magnitude of a second set-down reference voltage V4 supplied during the set-down period as shown in (a) of FIG. 8 is substantially equal to a ground level voltage GND as shown in (b) of FIG. 8. The reason to supply the second set-down reference voltage V4 of the magnitude substantially equal to the ground level voltage GND is to improve the stability of a driving circuit by supplying the ground level voltage GND to the scan electrode Y before the voltage of the scan electrode Y decreases to equal to or less than the ground level voltage GND.

Figure 9:
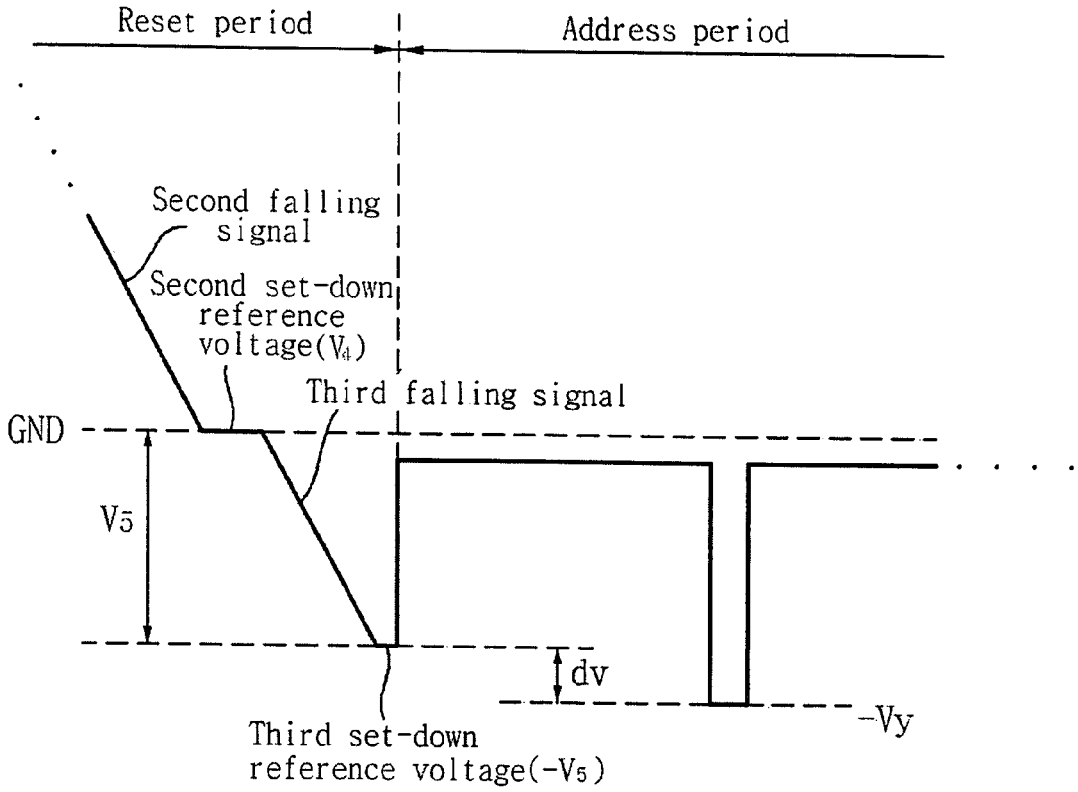
FIG. 9 illustrates a third set-down reference voltage supplied during the set-down period of the reset period in the plasma display apparatus according to the embodiment of the present invention.

FIG. 9 illustrates a third set-down reference voltage supplied during the set-down period of the reset period in the plasma display apparatus according to the embodiment of the present invention. As shown in FIG. 9, a magnitude of a third set-down reference voltage V5 is less than the magnitude of the voltage −Vy of the scan signal supplied to the scan electrode Y in the address period. The difference between the magnitude of the third set-down reference voltage V5 and the magnitude of the voltage −Vy of the scan signal is represented by a reference symbol dv.

The reason that a level of the third set-down reference voltage V5 is more than a level of the voltage −Vy of the scan signal is to prevent the generation of the address discharge by the third set-down reference voltage V5.

As shown in FIGS. 2, 8 and 9, in the plasma display apparatus according to the embodiment of the present invention, the second falling signal and the third falling signal are supplied to the scan electrode Y in at least one subfield of the plurality of subfields. Further, the second falling signal and the third falling signal may be supplied in the setup period. At least one of the second falling signal and the third falling signal may be supplied in the setup period.

Figure 10:
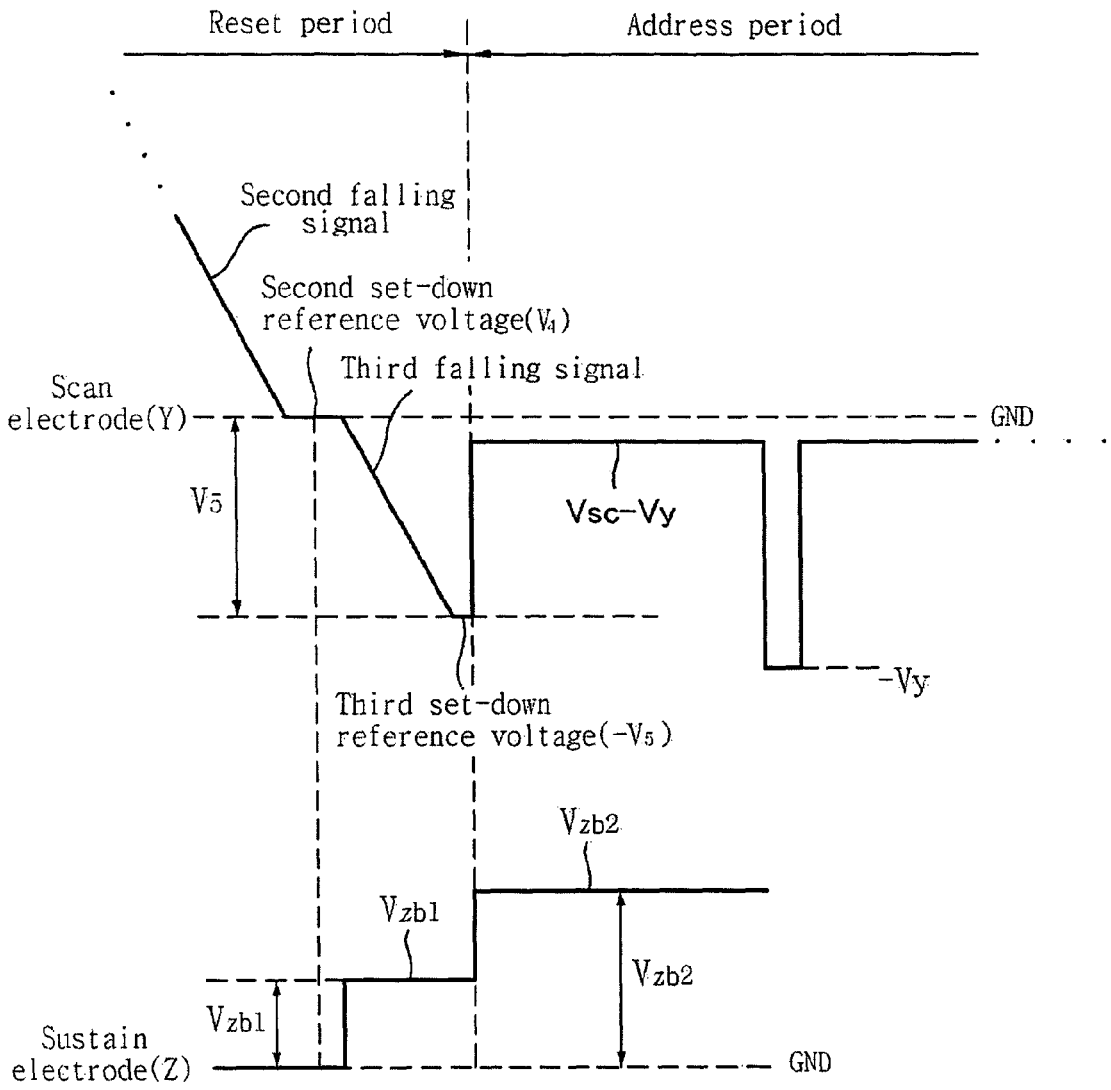
FIG. 10 illustrates a sustain bias voltage supplied during the set-down period of the reset period in the plasma display apparatus according to the embodiment of the present invention.

FIG. 10 illustrates a sustain bias voltage supplied during the set-down period of the reset period in the plasma display apparatus according to the embodiment of the present invention. As shown in FIG. 10, a first sustain bias voltage Vzb1 of a magnitude less than a magnitude of a second sustain bias voltage Vzb2 supplied in the address period is supplied to the sustain electrode Z during the supply of the third falling signal to the scan electrode Y. The magnitude of the first sustain bias voltage Vzb1 ranges from 40% to 60% of the magnitude of the second sustain bias voltage Vzb2

Further, the second sustain bias voltage Vzb2 is supplied during the duration of time from a supply finish time point of the third falling signal to a supply time point of the scan signal earliest supplied during the address period. The magnitude of the second sustain bias voltage Vzb2 is substantially equal to the magnitude of the voltage Vs of the sustain signal supplied in the sustain period. The magnitude of the first sustain bias voltage Vzb1 is less than the magnitude of the voltage of the third falling signal.

The reason to supply the first sustain bias voltage Vzb1 of the magnitude less than the magnitude of the second sustain bias voltage Vzb2 is to prevent the generation of an erroneous discharge in the vicinity of a boundary between the set-down period and the address period.

For example, when the ground level voltage is supplied to the sustain electrode Z during the supply of the third falling signal to the scan electrode Y, and the scan bias voltage Vsc-Vy is supplied to the scan electrode Y in the vicinity of the boundary between the set-down period and the address period, the second sustain bias voltage Vzb2 needs to be sharply supplied to the sustain electrode Z. When the second sustain bias voltage Vzb2 is sharply supplied to the sustain electrode Z, it is likely that unwanted discharge is generated between the scan electrode Y and the sustain electrode Z.

However, by supplying the first sustain bias voltage Vzb1 of the magnitude less than the magnitude of the second sustain bias voltage Vzb2 during the supply of the third falling signal to the scan electrode Y, unwanted discharge between the scan electrode Y and the sustain electrode Z is prevented.

Since the magnitude of the second sustain bias voltage Vzb2 is substantially equal to the magnitude of the voltage of the sustain signal in the embodiment of the present invention, a separate circuit for the generation of the second sustain bias voltage Vzb2 is not required. Thus, the manufacturing cost of the plasma display apparatus decreases.

Since the magnitude of the second sustain bias voltage Vzb2 is substantially equal to the magnitude of the voltage of the sustain signal, the magnitude of the scan bias voltage Vsc−Vy may be set to a small value to prevent the generation of the erroneous discharge caused by the large voltage difference between the scan electrode Y and the sustain electrode Z.

Figure 11:
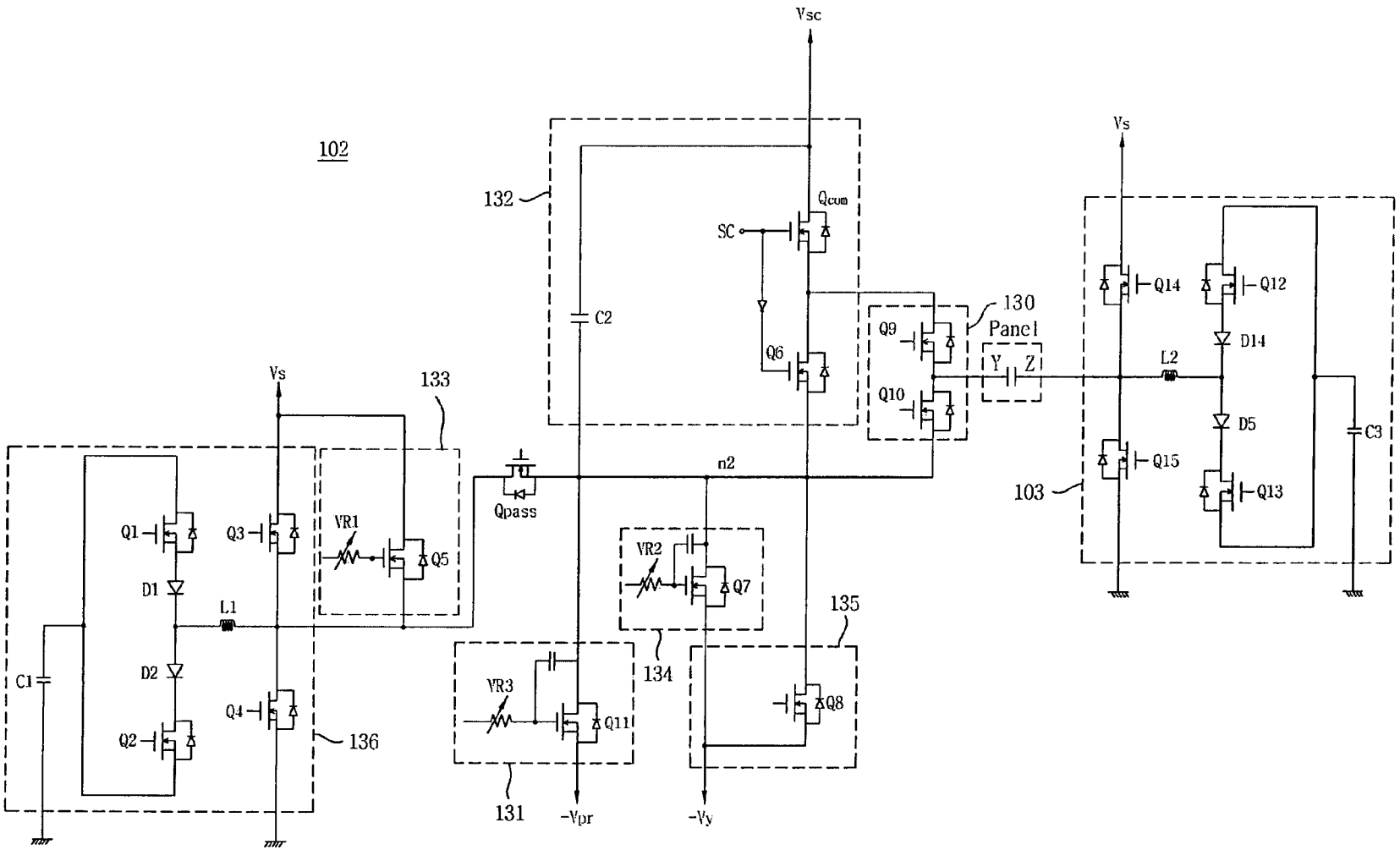
FIG. 11 illustrates a scan driver and a sustain driver of the plasma display apparatus according to the embodiment of the present invention.

FIG. 11 illustrates a scan driver and a sustain driver of the plasma display apparatus according to the embodiment of the present invention. As shown in FIG. 11, the scan driver 102 comprises a scan drive IC 130, a first falling signal supply unit 131, a scan reference voltage supply unit 132, a rising signal supply unit 133, a set-down signal supply unit 134, a scan signal supply unit 135, and a scan energy recovery circuit unit 136.

The scan drive IC 130 comprises a scan top switch Q9 and a scan bottom switch Q10. A common end of the scan top switch Q9 and the scan bottom switch Q10 is connected to the scan electrode Y.

The first falling signal supply unit 131 supplies the first falling signal to the scan electrode Y through the scan drive IC 130. The first falling signal supply unit 131 is disposed between the rising signal supply unit 133 and the set-down signal supply unit 134. The first falling signal supply unit 131 comprises a pre-reset ramp switch Q11 connected to a voltage source for generating the voltage −Vpr of the first falling signal, and a variable resistance VR3 which is connected to a gate terminal of the pre-reset lamp switch Q11 and controls a width of a channel.

The scan reference voltage supply unit 132 supplies the setup reference voltage Vsetup-base during the setup period of the reset period and the scan reference voltage Vsc during the address period to the scan electrode Y through the scan drive IC 130. The scan reference voltage supply unit 132 comprises a scan/setup common switch Qcom and a sixth switch Q6. A gate terminal of the scan/setup common switch Qcom and a gate terminal of the sixth switch Q6 are connected to NOT gate.

The rising signal supply unit 133 supplies the rising signal, which gradually rises from the setup reference voltage Vsetup-base, to the scan electrode Y through the scan drive IC 130.

The set-down signal supply unit 134 supplies the second falling signal, which gradually falls up to the second set-down reference voltage V4 in the set-down period, and the third falling signal, which gradually falls from the second set-down reference voltage V4 to the third set-down reference voltage V5 in the set-down period, to the scan electrode Y through the scan drive IC 130.

The scan signal supply unit 135 supplies the voltage −Vy of the scan signal to the scan electrode Y through the scan drive IC 130 in the address period.

A pass switch Qpass blocks selectively electrical connection between the scan energy recovery circuit unit 136 and the first falling signal supply unit 131.

The scan energy recovery circuit unit 136 supplies the sustain signal to the scan electrode Y through the scan drive IC 130 in the sustain period.

The sustain driver 103 will be described in detail with reference to FIG. 12.

Figure 12:
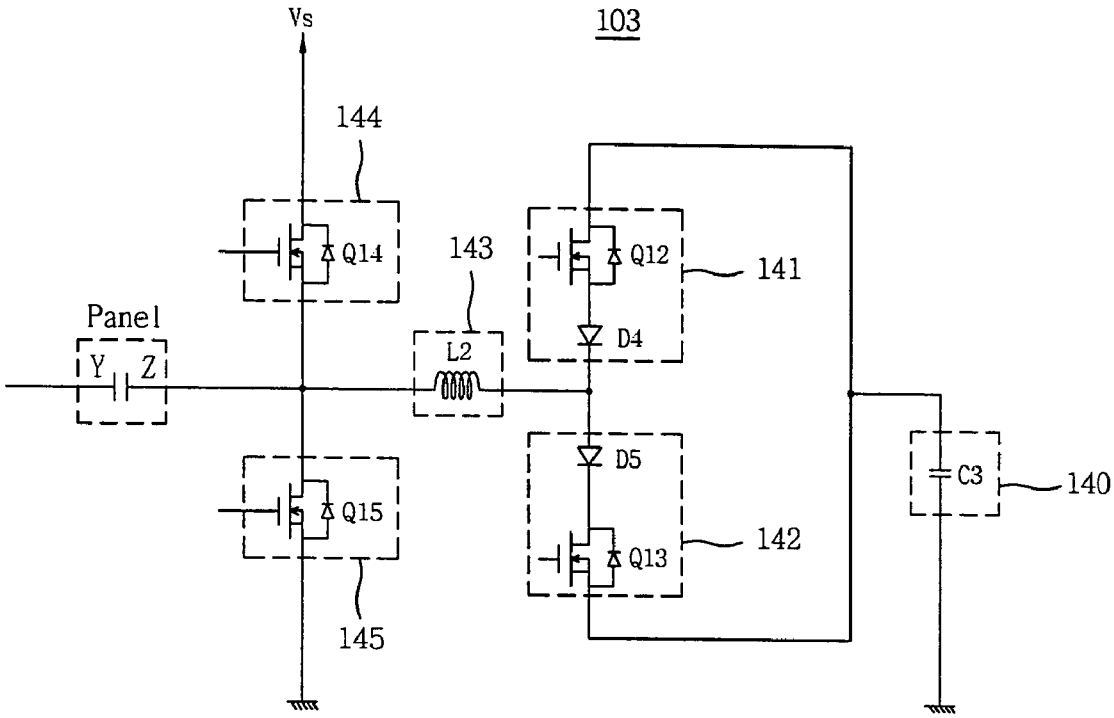
FIG. 12 illustrates the sustain driver of the plasma display apparatus according to the embodiment of the present invention.

FIG. 12 illustrates the sustain driver of the plasma display apparatus according to the embodiment of the present invention. As shown in FIG. 12, the sustain driver 103 of the plasma display apparatus according to the embodiment of the present invention comprises a sustain voltage source for supplying the sustain voltage Vs and a ground voltage source for supplying the ground level voltage.

The sustain driver 103 supplies the voltage Vs of the sustain signal to the sustain electrode Z in the sustain period and recovers energy supplied to the sustain electrode Z. The sustain driver 103 comprises an energy storing unit 140, an energy supply control unit 141, an energy recovery control unit 142, an inductor unit 143, a sustain voltage supply control unit 144, and a ground voltage supply control unit 145.

The energy storing unit 140 comprises an energy storage capacitor C3.

The energy supply control unit 141 comprises a twelfth switch Q12. The energy is supplied from the energy storing unit 140 to the sustain electrode Z in accordance with turn-on and turn-off operations of the twelfth switch Q12. The energy supply control unit 141 may further comprise a reverse blocking diode D4 for preventing an inverse current toward the energy storing unit 140 through the twelfth switch Q12.

The energy recovery control unit 142 comprises a thirteenth switch Q13. The energy is recovered from the sustain electrode Z to the energy storing unit 140 in accordance with turn-on and turn-off operations of the thirteenth switch Q13. The energy recovery control unit 142 may further comprise a reverse blocking diode D5 for preventing an inverse current toward the energy storing unit 140 through the thirteenth switch Q13.

The inductor unit 143 forms resonance when turning on the twelfth switch Q12 or the thirteenth switch Q13.

The sustain voltage supply control unit 144 comprises a fourteenth switch Q14. The sustain voltage Vs is supplied from the sustain voltage source to the sustain electrode Z in accordance with turn-on and turn-off operations of the fourteenth switch Q14.

The ground voltage supply control unit 145 comprises a fifteenth switch Q15. The ground level voltage is supplied from the ground voltage source to the sustain electrode Z in accordance with turn-on and turn-off operations of the fifteenth switch Q15.

Figure 13:
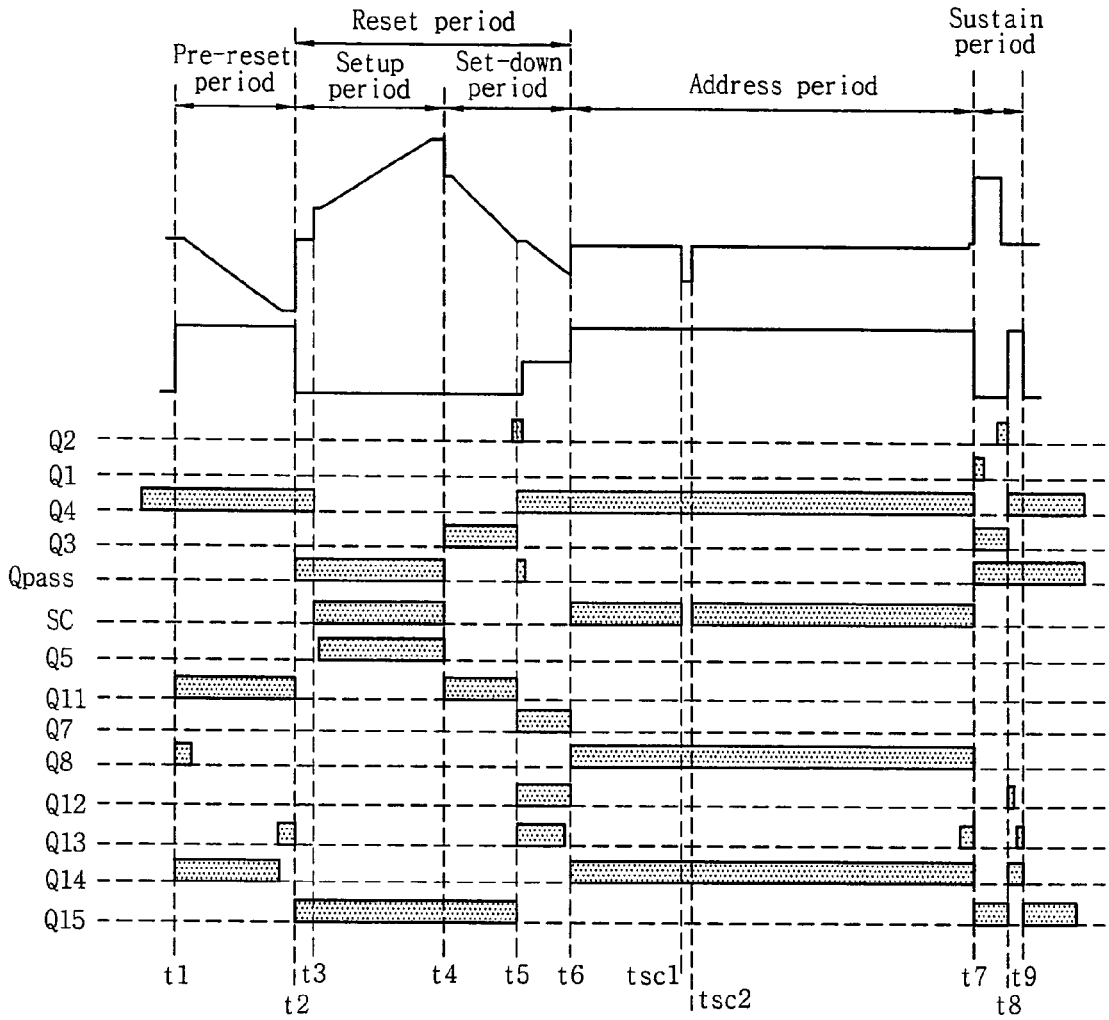
FIG. 13 is a switch timing chart of the scan driver and the sustain driver of the plasma display apparatus according to the embodiment of the present invention.

FIG. 13 is a switch timing chart of the scan driver and the sustain driver of the plasma display apparatus according to the embodiment of the present invention.

When a fourth switch Q4 of the scan driver 102 of FIG. 11 is turned on and the pre-reset ramp switch Q11 of the first falling signal supply unit 131 is turned on at a time point t1, the ground level voltage is supplied to the scan electrode Y. Afterwards, when the channel width is controlled by the variable resistance VR3 connected to the gate terminal of the pre-reset ramp switch Q11 of the first falling signal supply unit 131, the first falling signal of the magnitude more than the magnitude of the voltage −Vy of the scan signal is supplied.

When the fourteenth switch Q14 of the sustain voltage supply control unit 144 of FIG. 12 is turned on, the sustain voltage Vs is supplied to the sustain electrode Z. To easily rise the voltage of the sustain electrode Z to the sustain voltage Vs, the twelfth switch Q12 of the energy supply control unit 141 may be instantaneously turned on at the time point t1.

When the fourteenth switch Q14 is turned off and the thirteenth switch Q13 of the energy recovery control unit 142 is instantaneously turned on just before a time point t2, the energy is recovered to the energy storing unit 140.

Thus, the supply of the first falling signal to the scan electrode Y and the supply of the sustain signal to the sustain electrode Z stop at the time point t2. When the fourth switch Q4 of the scan energy recovery circuit unit 136 and the pass switch Qpass turn on and the fifteenth switch Q15 of the ground voltage supply control unit 145 is turned on at the time point t2, the ground level voltage is supplied to the scan electrode Y and the sustain electrode Z.

In a turn-on state of the fifteenth switch Q15 at the time point t3, the pass switch Qpass, the scan/setup common switch Qcom and a fifth switch Q5 are turned on, and the sixth switch Q6 is turned off by the Not gate. Thus, the setup reference voltage Vsetup-base of the magnitude equal to the magnitude of the scan reference voltage Vsc is supplied to the scan electrode Y.

When the fifth switch Q5 is turned on, the channel width is controlled by a variable resistance VR1 such that the rising signal, which gradually rises from the setup reference voltage Vsetup-base, is supplied to the scan electrode Y. The ground level voltage is supplied to the sustain electrode Z by constantly turning on the fifteenth switch Q15.

In a turn-on state of the fifteenth switch Q15 at a time point t4, the pass switch Qpass, the scan/setup common switch Qcom and the fifth switch Q5 are turned off, a third switch Q3 and the pre-reset ramp switch Q11 are turned on, and the sixth switch Q6 is turned on by the Not gate.

The sustain voltage Vs is supplied to the scan electrode Y by a turn-on operation of the third switch Q3. The channel width is controlled by the variable resistance VR3 such that the second falling signal is supplied to the scan electrode Y. The ground level voltage is supplied to the sustain electrode Z by constantly turning on the fifteenth switch Q15.

A second switch Q2 is instantaneously turned on just before the start of a time point t5 such that the energy is recovered from the scan electrode Y to a capacitor C1.

The fifteenth switch Q15, the third switch Q3 and the pre-reset ramp switch Q11 are turned off at the time point t5. Further, the fourth switch Q4, a seventh switch Q7, the twelfth Q12 and the thirteenth switch Q13 are turned on at the time point t5.

By instantaneously turning on the pass switch Qpass at the time point t5, the ground level voltage is instantaneously supplied to the scan electrode Y. As a result, the voltage of the scan electrode Y is the second set-down reference voltage V4. The channel width is controlled by a variable resistance VR2 such that the third falling signal, which gradually falls from the second set-down reference voltage V4, is supplied to the scan electrode Y.

Figure 14:
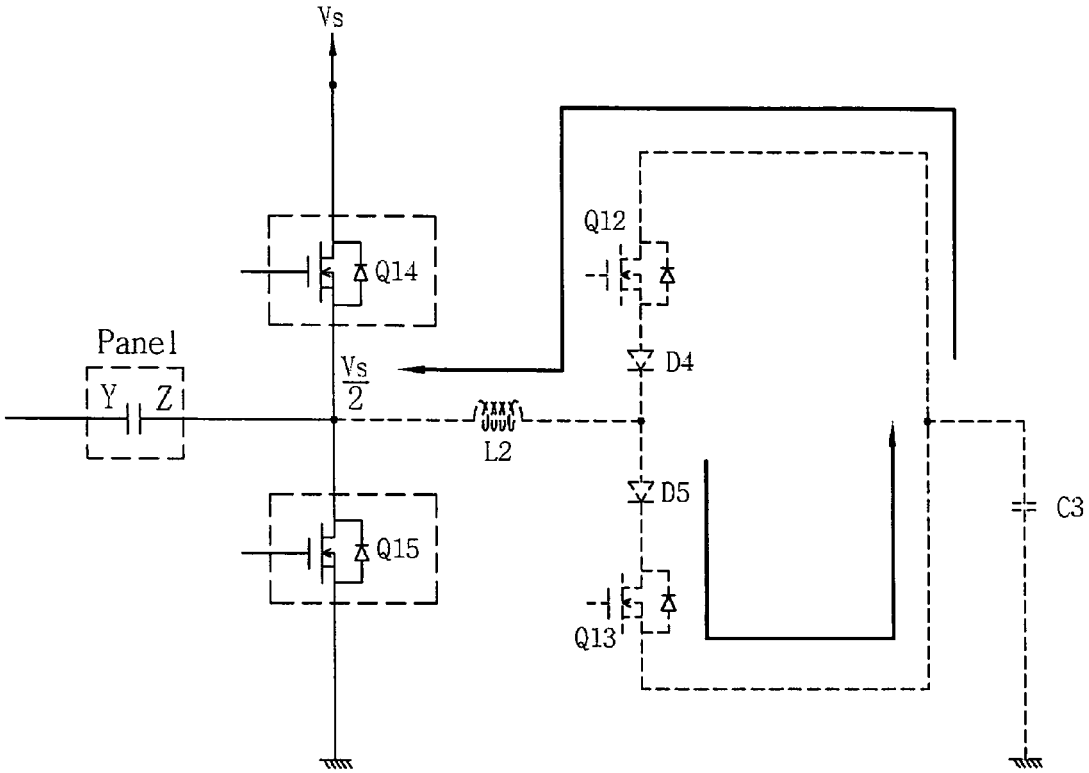
FIG. 14 illustrates an operation of the sustain driver of the plasma display apparatus according to the embodiment of the present invention.

FIG. 14 illustrates an operation of the sustain driver of the plasma display apparatus according to the embodiment of the present invention. As shown in FIG. 14, when the twelfth switch Q12 and the thirteenth switch Q13 of the sustain driver 103 are turned on, a current path from the energy storage capacitor C3 to the sustain electrode Z is formed, and at the same time a current path from the sustain electrode Z to the energy storage capacitor C3 is formed.

Thus, since the voltage of the sustain electrode Z is equal to a voltage of the energy stored in the energy storage capacitor C3, subsequent to the time point t5 of FIG. 13, a voltage of Vs/2 is supplied to the sustain electrode Z.

At a time point t6, the fourth switch Q4 is constantly turned on and the pass switch Qpass is constantly turned off. The seventh switch Q7, the twelfth switch Q12 and the thirteenth switch Q13 are turned off. Further, at the time point t6, the fourteenth switch Q14, a eighth switch Q8 and the scan/setup common switch Qcom are turned on. The sixth switch Q6 is turned off by the NOT gate.

Thus, the voltage of the scan electrode Y is substantially equal to the scan bias voltage (=Vsc−Vy) by the supply of the scan reference voltage Vsc and the voltage −Vy of the scan signal to the scan electrode Y. During the duration time from tsc1 time point to tsc2 time point, the scan/setup common switch Qcom is turned off and the turn-on state of the eighth switch Q8 remains, and the voltage −Vy of the scan signal is supplied to the scan electrode Y. Accordingly, the voltage of the scan electrode Y falls from the scan bias voltage (=Vsc−Vy) to the voltage −Vy of the scan signal. Thus, the scan signal is supplied to the scan electrode Y. The second sustain bias voltage Vzb2 is supplied to the sustain electrode Z by the turn-on operation of the fourteenth switch Q14.

The embodiment of the invention being thus described may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus, comprising:

a plasma display panel having a first electrode and a second electrode that are separated from each other by a distance greater than 100 μm and less than or equal to 150 μm;

a first electrode driver for supplying a first falling signal in a pre-reset period to the first electrode before supplying a rising signal in at least one subfield of several subfields of a frame; and a second electrode driver for supplying a second signal having a polarity opposite to a polarity of the first falling signal to the second electrode during the supply of the first falling signal, wherein a voltage magnitude of a lowest voltage of the first falling signal is greater than a voltage magnitude of a lowest voltage of a scan signal supplied during an address period, the first falling signal is gradually falling to the lowest voltage of the first falling signal, and the second signal sharply rises to a first voltage, wherein subsequent to application of the rising signal in the at least one subfield, the first electrode driver is adapted to supply a second falling signal and a third falling signal each having linear waveforms in a reset period, and the second falling signal has a polarity equal to a polarity of the rising signal, and the third falling signal has a polarity opposite to the polarity of the rising signal, wherein the first falling signal and the second signal are supplied in the at least one subfield of the several subfields of the frame, and the at least one subfield is first arranged among the several subfields in time order, wherein the second electrode driver comprises an energy recovery circuit unit for supplying a voltage of a sustain signal to the second electrode during a sustain period that follows the reset period before the address period, and the second electrode driver supplies a first sustain bias voltage to the second electrode by using a voltage charged to at least one capacitor of the energy recovery circuit unit in a part of a whole period when the third falling signal is supplied during the reset period, and a magnitude of the first sustain bias voltage is substantially equal to half of a voltage magnitude of the sustain signal.

2. The plasma display apparatus of claim 1, wherein the voltage magnitude of the lowest voltage of the first falling signal is substantially equal to or less than three times the voltage magnitude of a lowest voltage of the scan signal, and the voltage magnitude of the lowest voltage of the scan signal is less than the voltage magnitude of the lowest voltage of the first falling signal, and wherein the first falling signal gradually falls to the lowest voltage of the first falling signal.

3. The plasma display apparatus of claim 1, wherein a voltage magnitude of the second signal is substantially equal to or less than a voltage magnitude of a sustain signal supplied to the first electrode or the second electrode during the sustain period that follows the address period.

4. The plasma display apparatus of claim 1, wherein the rising signal rises from a setup reference voltage greater than a ground voltage.

5. The plasma display apparatus of claim 4, wherein a magnitude of the setup reference voltage is substantially equal to the voltage magnitude of the scan reference voltage supplied to the first electrode during the address period.

6. The plasma display apparatus of claim 4, wherein a voltage magnitude of a highest voltage of the rising signal is substantially equal to a sum of a voltage magnitude of a highest voltage of a sustain signal supplied to the first electrode or the second electrode during the sustain period and the magnitude of a scan reference voltage that is supplied to the first electrode during the address period.

7. The plasma display apparatus of claim 1, wherein a voltage magnitude of a highest voltage of the second falling signal is substantially equal to a voltage magnitude of a highest voltage of a sustain signal supplied to the first electrode or the second electrode during the sustain period, and a voltage magnitude of a lowest voltage of the second falling signal is substantially equal to a ground voltage.

8. The plasma display apparatus of claim 1, wherein a lowest voltage of the third falling signal is less than the voltage magnitude of a lowest voltage of the scan signal supplied to the first electrode during the address period.

9. The plasma display apparatus of claim 1, wherein a voltage magnitude of the first sustain bias voltage is less than a voltage magnitude of a second sustain bias voltage supplied to the second electrode during the address period of at least one subfield.

10. The plasma display apparatus of claim 1, wherein the voltage magnitude of the first sustain bias voltage ranges from 40% to 60% of the voltage magnitude of the second sustain bias voltage.

11. The plasma display apparatus of claim 1, wherein the second sustain bias voltage is supplied during a time interval between an ending point of the third falling signal and a starting point of the scan signal first supplied during the address period.

12. The plasma display apparatus of claim 1, wherein the voltage magnitude of the second sustain bias voltage is substantially equal to or less than the voltage magnitude of a sustain signal supplied to the first electrode or the second electrode during the sustain period.

13. The plasma display apparatus of claim 1, wherein the distance between the first electrode and the second electrode ranges from 120 um to 150 um.

14. The plasma display apparatus of claim 1, wherein the second falling signal and the third falling signal are separated from each other by only a linear signal, and wherein a voltage of the linear signal is at a ground level.

15. The plasma display apparatus of claim 1, wherein the first falling signal and the scan signal are both of a same negative polarity.

16. The plasma display apparatus of claim 1, wherein the first falling signal and the second signal are omitted in subfields other than the at least one subfield.

17. The plasma display apparatus of claim 1, wherein the energy recovery circuit unit comprises:

an inductor disposed between the at least one capacitor and the second electrode, a first switch between the at least one capacitor and the second electrode, and a second switch disposed between the at least one capacitor and the second electrode and in parallel with the first switch, and wherein the first sustain bias voltage is supplied to the second electrode when the first switch and the second switch are turned on simultaneously.

* * * * *